US008353171B2

(12) United States Patent
Feinauer et al.

(10) Patent No.: US 8,353,171 B2
(45) Date of Patent: Jan. 15, 2013

(54) REFRIGERATING APPLIANCE COMPRISING AN ICE-MAKING MACHINE

(75) Inventors: Adolf Feinauer, Giengen (DE); Klaus Flinner, Zöschingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 833 days.

(21) Appl. No.: 12/516,626

(22) PCT Filed: Dec. 10, 2007

(86) PCT No.: PCT/EP2007/063605

§ 371 (c)(1),
(2), (4) Date: May 28, 2009

(87) PCT Pub. No.: WO2008/077750

PCT Pub. Date: Jul. 3, 2008

(65) Prior Publication Data

US 2010/0064704 A1 Mar. 18, 2010

(30) Foreign Application Priority Data

Dec. 22, 2006 (DE) ..... 10 2006 061 155

(51) Int. Cl.

| | |
|---|---|
| ***F25B 49/00*** | (2006.01) |
| ***F25C 1/22*** | (2006.01) |
| ***F25D 17/02*** | (2006.01) |
| ***F25D 11/02*** | (2006.01) |

(52) U.S. Cl. ..... 62/132; 62/340; 62/441; 62/434

(58) Field of Classification Search ..... 62/132, 62/340, 344, 441, 435, 434

See application file for complete search history.

(56) References Cited

U.S. PATENT DOCUMENTS

| | | | | |
|---|---|---|---|---|
| 3,788,089 | A * | 1/1974 | Graves | 62/137 |
| 4,799,362 | A | 1/1989 | Chestnut | |
| 4,872,317 | A | 10/1989 | Reed | |
| 4,924,678 | A * | 5/1990 | Ito | 62/138 |
| 5,187,948 | A | 2/1993 | Frohbieter | |
| 5,485,397 | A | 1/1996 | Yamazato et al. | |
| 6,658,879 | B2 * | 12/2003 | Park et al. | 62/229 |
| 2006/0086130 | A1 * | 4/2006 | Anselmino et al. | 62/344 |
| 2006/0196214 | A1 * | 9/2006 | Lee et al. | 62/344 |
| 2007/0163282 | A1 * | 7/2007 | Cushman et al. | 62/340 |
| 2007/0251259 | A1 | 11/2007 | Kim et al. | |

FOREIGN PATENT DOCUMENTS

| | | | |
|---|---|---|---|
| DE | 20115821 | U1 | 4/2002 |
| DE | 10336834 | A1 | 3/2005 |
| JP | 08152162 | A * | 6/1996 |

* cited by examiner

*Primary Examiner* — Chen Wen Jiang

(74) *Attorney, Agent, or Firm* — James E. Howard; Andre Pallapies

(57) ABSTRACT

A refrigerating appliance is provided that includes an inner compartment for storing refrigerated or frozen goods, a cold generator, a refrigerating appliance control system for operating the cold generator, a mains connection for supplying the cold generator and the refrigerating appliance control system with an electrical voltage, and an ice-making machine arranged in the inner compartment. The ice-making machine includes its own control system for its own operation, which controls all functions of the ice-making machine independently of the refrigerating appliance control system. A connection is also provided from the ice-making machine and the ice-making machine control system to the mains connection of the refrigerating appliance.

22 Claims, 2 Drawing Sheets

REFRIGERATING APPLIANCE COMPRISING AN ICE-MAKING MACHINE

BACKGROUND OF THE INVENTION

The invention relate to a refrigerator.

It is known to dispose ice makers in the refrigeration compartment of refrigerators. In these cases ice makers are used which are filled with water and externally cooled, the water freezing from outside to inside and finally producing an ice cube. In addition, there are so-called clear ice makers in which a plurality of cooling fingers are immersed in a water-filled container. The refrigerant circulating inside the ice fingers causes the latter to be cooled down such that a layer of ice forms on the cooling fingers immersed in the water. As soon as the layer of ice on the cooling fingers has reached a usable size, it is released from the cooling fingers. A clear ice maker of this kind is described in DE 103 36 834 A1. This type of icemaker is finally available in a plurality of embodiments. Such ice makers are generally installed in the refrigeration compartment of a combined refrigerator/freezer.

The cold generator of the refrigerator generally consists of a refrigerant circuit for a refrigerant, comprising a compressor, a condenser and an evaporator which removes heat from the space to be cooled and transfers it to the refrigerant. The evaporators are generally implemented as wire tube evaporators, which means that the evaporators act as heat exchangers. They are mostly mounted horizontally inside the refrigerators. In the case of wire tube evaporators, the evaporator tube carrying the refrigerant is bent into parallel loops. The tube loops are fixed—mainly spot-welded—to wire rods and thus stabilized. The wire rods run in parallel spacings at right angles to the straight sections of the tube loops, above and below them. The purpose of connecting the refrigerant-carrying tube loops to the wire rods is, on the one hand, to prevent the tube loops from sagging and, on the other, to achieve higher cooling efficiency by increasing the surface area.

If an ice maker is provided in the refrigerator, it can be connected, for example, to the refrigerant circuit of the refrigerator. Another possibility is to equip the ice maker with a refrigerant circuit of its own and thermally couple the latter to the refrigerator's evaporator.

In order to ensure that a predefined temperature is maintained inside refrigerators, a control unit is normally provided which is connected to one or more temperature sensors and controls the cold generator accordingly. Said control units are in each case adapted to suit the type of refrigerator and may therefore be very different. If an ice maker is now to be provided for the refrigerator, complex and time-consuming adaptation work is necessary in order to enable the ice maker to be connected to the refrigerator control unit.

BRIEF SUMMARY OF THE INVENTION

The object of the invention is to create a refrigerator such that an ice maker provided in the refrigerator does not need to be adapted to the refrigerator's control unit.

This object is achieved according to the invention by a refrigerator. As the ice maker has its own control unit, no adaptation of any kind needs to be carried out on the refrigerator control unit. As a result, an ice maker with its own control unit can be incorporated in virtually any type of refrigerator. For this purpose no adaptations are necessary either on the refrigerator control unit or on the ice maker control unit.

Such ice makers with their own control unit are particularly suitable for use in a refrigerator which is subdivided into a refrigeration compartment and a freezer compartment.

Refrigerators of this kind often have only one evaporator which is disposed in the freezer compartment. For such refrigerators it is not necessary to provide the ice maker with a separate evaporator which would have to be connected to the refrigerator's refrigerant circuit. In this case it is sufficient to equip the ice maker with a refrigerant circuit which is thermally coupled to the refrigerator's evaporator. The temperature of the evaporator in the refrigerator's freezer compartment is sufficiently low to keep the ice maker's refrigerant circuit at the necessary temperature.

It has been found, however, that with continuous ice production the temperature in the freezer compartment of the refrigerator can increase too strongly. As this may damage the frozen items, it is imperative that a temperature increase of this kind be prevented. For this purpose it is necessary for the ice maker's control unit to detect the temperature in the freezer compartment of the refrigerator directly or indirectly. In one embodiment of the invention, a sensor is therefore mounted on the refrigerator's evaporator. Said sensor ascertains the temperature of the refrigerant in the evaporator. As the temperature of the refrigerant is proportional to the temperature of the freezer compartment, the temperature obtaining in the freezer compartment can be simply inferred therefrom.

In another exemplary embodiment of the invention, there is provided in the freezer compartment a sensor which directly measures the temperature in the freezer compartment. For this purpose the ice maker is not only equipped with its own control unit, but must also have its own temperature sensor. In order to avoid such additional costs as far as possible, in a further development of this example a temperature sensor is therefore used which is already required by the refrigerator's control unit and is connected thereto. According to the invention, this sensor is connected to the ice maker's controller in the freezer compartment such that the sensor signal can be used both by the refrigerator's control unit and by the ice maker's control unit.

In both examples the ice maker's control unit detects an excessive temperature increase in the freezer compartment via a sensor. In order to now prevent the frozen items from being damaged, ice making is interrupted and the ice maker is switched off by the ice maker's control unit. The ice maker can be switched back on either on a time-controlled basis after a predefined time period, or else when a particular temperature has been reached in the freezer compartment. In both cases it is ensured that ice making is not resumed until the risk of damaging the frozen items is averted.

BRIEF DESCRIPTION OF THE DRAWINGS

Further details and advantages of the invention will emerge from the sub-claims in conjunction with the description of an exemplary embodiment which will be explained in detail with reference to the accompanying drawings in which:

DETAILED DESCRIPTION OF THE PRESENT INVENTION

Figure 1:
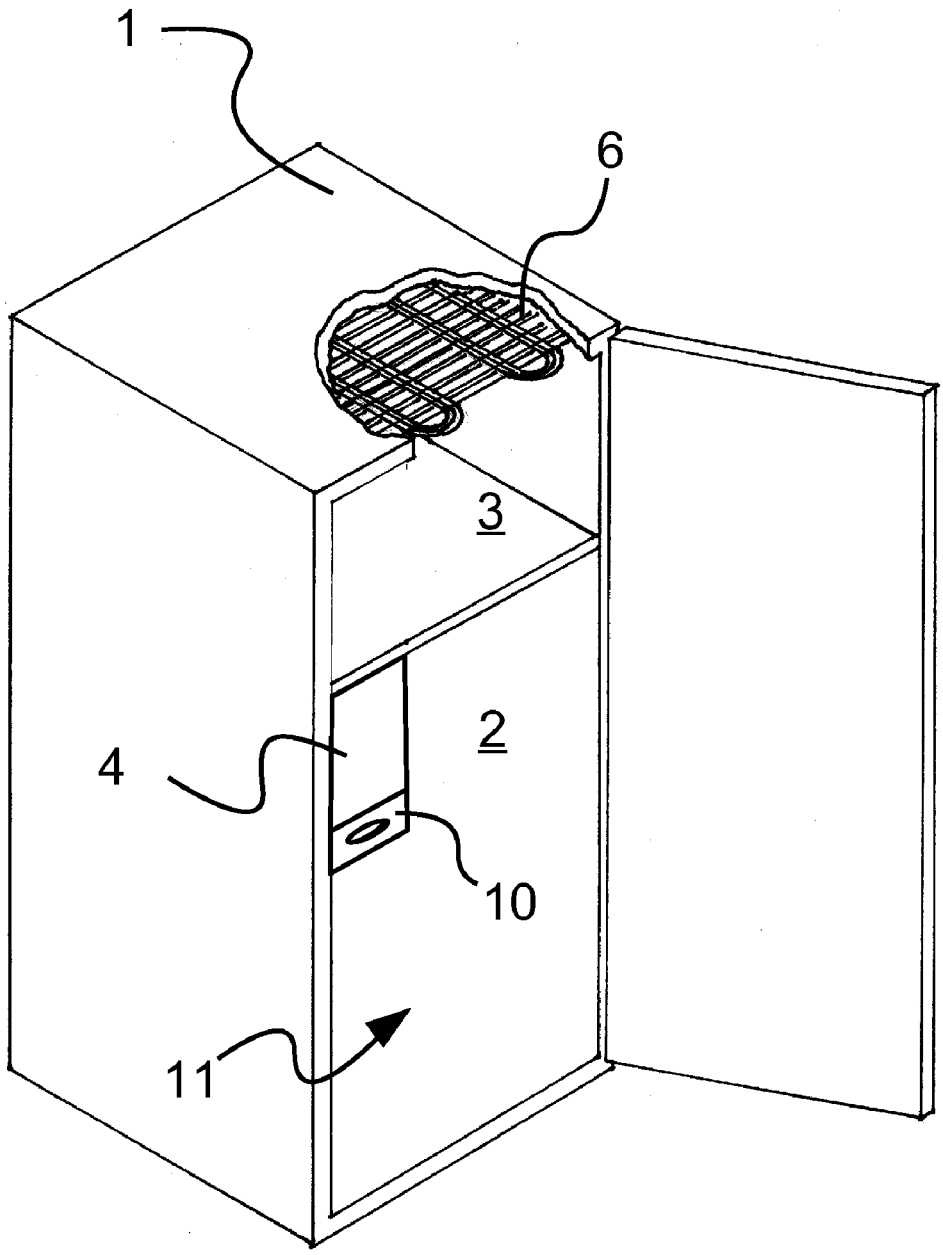
FIG. 1 shows a refrigerator with freezer compartment and ice maker.

FIG. 1 shows a refrigerator 1 with open door and an interior space 11. The interior space 11 is subdivided into a refrigeration compartment 2 and a freezer compartment 3. For the sake of clarity, the freezer compartment 3 is shown with no door. An ice maker 4 is located in the refrigeration compartment 2. In said ice maker 4, in a process not described in greater detail here, clear ice is produced by means of a plurality of cooling fingers and deposited in a collecting tray 10. The collecting tray 10 is located beneath the ice maker 4. The cold required for producing the clear ice is generated using a heat exchanger 5 (see FIG. 2) which is fixed to the cooling fingers.

Figure 2:
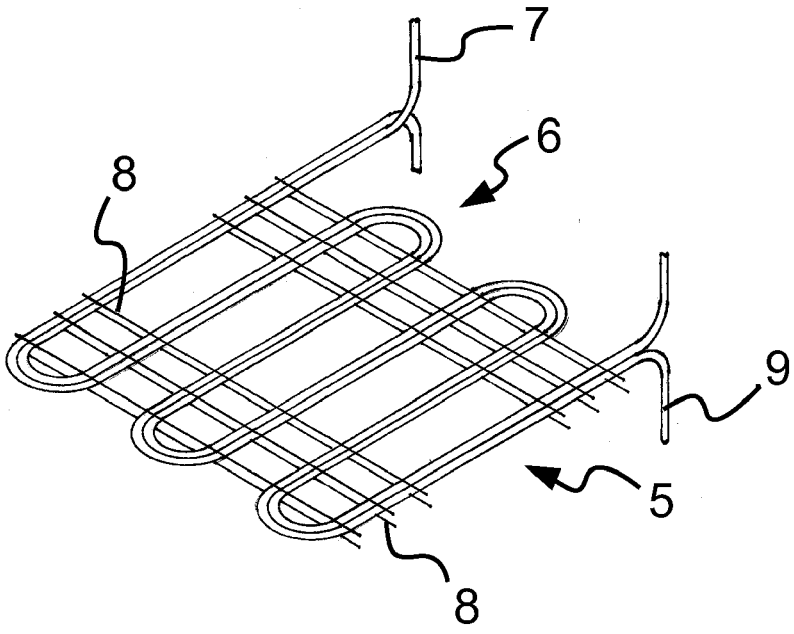
FIG. 2 shows a detail view of a wire tube evaporator with heat exchanger connected and FIG. 3 shows a schematic diagram of an exemplary embodiment of a refrigerator according to the invention.

The wire tube evaporator 6 horizontally mounted in the freezer compartment 3 consists of an evaporator tube 7 bent into parallel loops. The evaporator tube 7 of the wire tube evaporator 6 is fixed above and below to wire rods 8 all running parallel to the end face and equidistantly from one another. Attaching the wire rods 8 on the one hand increases the surface area, thereby enabling the heat from the freezer compartment 3 to be better absorbed, and on the other hand prevents the evaporator tube 7 of the wire tube evaporator 6 from sagging. For the sake of clarity, only the wire rods 8 of the wire tube evaporator 6 that are on the end face and on the opposite side thereto are shown in FIG. 2.

The heat exchanger 5 consists of a heat exchanger tube 9. In the region of the wire tube evaporator 6, the heat exchanger tube 9 of the heat exchanger 5 is likewise looped parallel with the evaporator tube 7 in the same plane, said heat exchanger tube 9 of the heat exchanger 5 being located between the wire rods 8 in precisely the same way as the evaporator tube 7 of the wire tube evaporator 6.

In order to enable sufficient heat to be coupled from the heat exchanger 5 into the wire tube evaporator 6, good thermal contact between these two components is necessary. For this purpose the heat exchanger tube 9 of the heat exchanger 5 is fixed to the evaporator tube 7 and the lower and upper wire rods 8 of the wire tube evaporator 6. The heat exchanger tube 9 of the heat exchanger 5 has the same external diameter and consists of the same material as the evaporator tube 7 of the wire tube evaporator 6.

To provide good thermal conductivity, spot welding, soldering or adhesive bonding are possible. In addition, a coating, in particular a powder coating applied to the assembled heat exchanger 5 and wire tube evaporator 6 construction is sufficiently thermally conductive.

A cooling brine, a water-alcohol mixture or a water-glycol mixture are used as the cooling medium in the heat exchanger 5.

Figure 3:
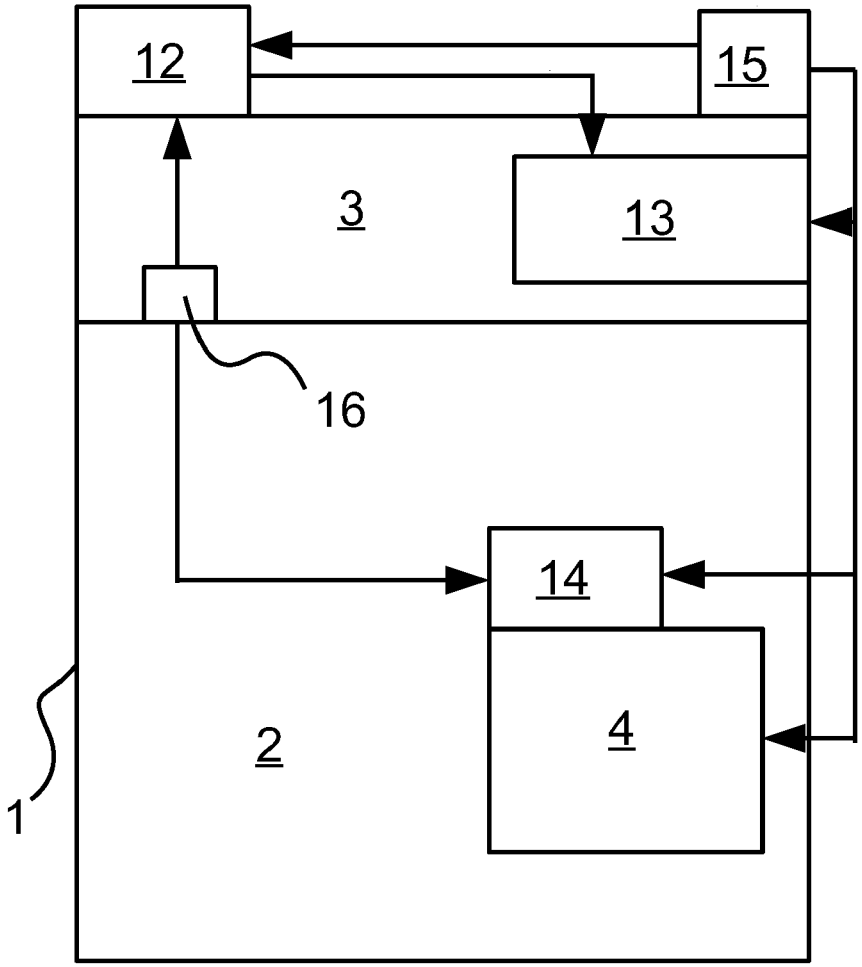

FIG. 3 now shows a schematic diagram of an exemplary embodiment of the refrigerator according to the invention. A refrigerator 1 is subdivided into a refrigeration compartment 2 and a freezer compartment 3. The cold generator 13 is shown inside the freezer compartment 3, as the associated evaporator is located there. A refrigerator control unit 12 and a line power terminal 15 are provided outside the cooled interior space.

The ice maker 4 with the ice maker control unit 14 are located in the refrigeration compartment 2. The refrigerator control unit 12, the ice maker control unit 14, the cold generator 13 and the ice maker 4 are connected to the line power terminal 15 so that these components can be supplied with electric current.

The temperature sensor 16 is mounted in the freezer compartment 3. Both the refrigerator control unit 12 and the ice maker control unit 14 are supplied with the signal from the temperature sensor 16. The cold generator 13 is controlled by the refrigerator control unit 12 on the basis of the freezer compartment temperature.

If required, the ice maker 4 is started via a switch not shown here. As the ice maker 4 takes the required cold from the cold generator 13, it can happen that, if the ice maker is intensively used, the output of the cold generator 13 is no longer adequate and the temperature in the freezer compartment 3 rises as a result. This temperature increase is detected by the sensor 16. A threshold value for the detected freezer compartment temperature is stored in the ice maker control unit 14. If said threshold value is exceeded, the ice maker control unit 14 switches off the ice maker 4. This idle time of the ice maker 4 lasts until the temperature in the freezer compartment 3 falls below a temperature stored as a second threshold value in the ice maker control unit 14. Ice production is not restarted by the ice maker control unit 14 until the temperature is below said threshold value.

In the freezer compartment 3, it is likewise possible to provide an additional sensor which is exclusively connected to the ice maker control unit 14. However, an additional sensor can also be provided on the refrigerator's evaporator and the temperature of the freezer compartment 2 determined indirectly.

In all the exemplary embodiments of the refrigerator according to the invention, the ice maker 4 has its own control unit 14. Said control unit 14 is designed for the ice maker 4 and does not need to be adapted to suit the type of refrigerator or its control unit 12. It is merely necessary for the refrigerator to have means of supplying voltage to both the ice maker 4 and its control unit 14. It is therefore possible for different types of ice makers to be installed in different types of refrigerators without special adaptation work having to be carried out.

List of Reference Characters:

1 refrigerator
2 refrigeration compartment
3 freezer compartment
4 ice maker
5 heat exchanger
6 wire tube evaporator
7 evaporator tube
8 wire rod
9 heat exchanger tube
10 collecting tray
11 interior space
12 refrigerator control unit
13 cold generator
14 ice maker control unit
15 line power
16 freezer compartment sensor

The invention claimed is:

1. A refrigerator comprising:

an interior space for storing chilled or frozen items;

a cold generator;

a refrigerator control unit for operating the cold generator;

a line power connection for supplying voltage to the cold generator and the refrigerator control unit;

an ice maker disposed in the interior space, separate from a door of the refrigerator, the ice maker comprising a dedicated ice maker control unit solely for operating the ice maker, the ice maker control unit, is separate from, and controls all the functions of the ice maker independently of the refrigerator control unit, and the ice maker and the ice maker control unit are connected to the line power connection, and wherein the ice maker and ice maker control unit comprise a unitary integrated unit; and a sensor connected to at least the ice maker control unit that senses a temperature of a freezer compartment, wherein the ice maker control unit switches off the ice maker if the sensor detects a temperature that is above a first particular threshold value.

2. The refrigerator as claimed in claim 1, wherein the interior space of the refrigerator is subdivided into a refrigeration compartment and a freezer compartment and the cold generator has an evaporator in the freezer compartment.

3. The refrigerator as claimed in claim 2, wherein a refrigerant circuit for the ice maker is thermally coupled to the evaporator.

4. The refrigerator as claimed in claim 2 wherein the sensor is provided on the evaporator.

5. The refrigerator as claimed in claim 2, wherein the evaporator has an evaporator tube bent into parallel loops, and wherein the cold generator further comprises a heat exchanger having a heat exchanger tube looped parallel with and in thermal contact with the evaporator tube in the same plane, and wire rods running parallel to one another and space equidistantly from one another, wherein the evaporator tube and the heat exchanger tube is attached between the wire rods.

6. The refrigerator as claimed in claim 5, wherein the heat exchanger tube has substantially the same external diameter and comprises substantially the same material as the evaporator tube.

7. The refrigerator as claimed in claim 5, wherein the heat exchanger tube and the evaporator tube are one of spot welded, soldered or adhesively bonded together.

8. The refrigerator as claimed in claim 5, wherein the heat exchanger tube and the evaporator tube are coated with a powder coating.

9. The refrigerator as claimed in claim 2, the sensor is provided on the evaporator and is connected exclusively to the ice maker control unit.

10. The refrigerator as claimed in claim 9, wherein the ice maker control unit switches off the ice maker if the sensor detects a temperature that is above a first particular threshold value.

11. The refrigerator as claimed in claim 1, wherein the sensor for sensing a temperature of the freezer compartment is connected to the refrigerator control unit and the ice maker control unit.

12. The refrigerator as claimed in claim 1, further comprising a collecting tray disposed beneath the ice maker.

13. The refrigerator as claimed in claim 1, wherein the refrigerator control unit and the line power connection are provided outside the interior space.

14. The refrigerator as claimed in claim 1, wherein the cold generator is controlled by the refrigerator control unit on the basis of the freezer compartment temperature.

15. The refrigerator as claimed in claim 1, wherein the ice maker control unit switches on the ice maker once the temperature in the freezer compartment returns to a temperature below a second particular threshold value.

16. The refrigerator as claimed in claim 15, wherein the first and second threshold value temperatures are stored in the ice maker control unit.

17. The refrigerator as claimed in claim 1 wherein the sensor is provided in the freezer compartment.

18. The refrigerator as claimed in claim 1, wherein the sensor for sensing a temperature of the freezer compartment is connected exclusively to the ice maker control unit.

19. The refrigerator as claimed in claim 18, wherein the ice maker control unit switches off the ice maker if the sensor detects a temperature that is above a first particular threshold value.

20. The refrigerator as claimed in claim 1, wherein installing the ice maker into the interior space of the refrigerator, comprises positioning the ice maker in the interior space of the refrigerator; and connecting the ice maker and ice maker control unit to the line power connection.

21. The refrigerator as claimed in claim 20, wherein installing the ice maker requires substantially no adaptation to the refrigerator control unit or the ice maker control unit.

22. A method of installing an ice maker in a refrigerator, comprising:

positioning an ice maker comprising a dedicated ice maker control unit that controls all the functions of the ice maker in an interior space of a refrigerator separate from a door of the refrigerator, the refrigerator having a refrigerator control unit, a cold generator and a line power connection;

connecting the ice maker and ice maker control unit to the line power connection, wherein, the ice maker control unit, is separate from, and operates the ice maker and controls all the functions of the ice maker independently of the refrigerator control unit; and wherein the refrigerator includes a sensor connected to at least the ice maker control unit that senses a temperature of a freezer compartment, wherein the ice maker control unit switches off the ice maker if the sensor detects a temperature that is above a first particular threshold value.

* * * * *